US006979000B1

(12) United States Patent
Vahala

(10) Patent No.: US 6,979,000 B1
(45) Date of Patent: Dec. 27, 2005

(54) RACING GAME

(76) Inventor: Anthony Vahala, 1065 Thornrose Way, Wake Forest, NC (US) 27587

( * ) Notice: Subject to any disclaimer, the term of this patent is extended or adjusted under 35 U.S.C. 154(b) by 204 days.

(21) Appl. No.: 10/401,197

(22) Filed: Mar. 27, 2003

(51) Int. Cl.[7] ..... A63F 3/00
(52) U.S. Cl. ..... 273/246; 273/236
(58) Field of Search ..... 273/236, 246, 273/138.1

(56) References Cited

U.S. PATENT DOCUMENTS

| | | | | |
|---|---|---|---|---|
| 4,114,290 | A * | 9/1978 | Cooper | 434/200 |
| 4,426,084 | A * | 1/1984 | Michel | 273/254 |
| 5,322,293 | A | 6/1994 | Goyette | |
| 5,449,174 | A * | 9/1995 | Criner | 273/145 C |
| 5,934,673 | A * | 8/1999 | Telarico et al. | 273/246 |
| 6,095,522 | A | 8/2000 | Spell et al. | |
| 6,464,223 | B2 * | 10/2002 | Rutter | 273/246 |
| 6,471,209 | B1 | 10/2002 | Barshinger | |

* cited by examiner

*Primary Examiner*—Vishu K. Mendiratta
(74) *Attorney, Agent, or Firm*—Coats & Bennett, P.L.L.C.

(57) ABSTRACT

A racing game permits two or more players to compete by taking turns incrementally moving their game pieces around a race track comprising a plurality of discrete track positions. Each track position corresponds to a game command or to a race vehicle. Landing on a game command requires the player to perform that command, which may have bonus or penalty effect, depending on the particulars of the command. Landing on a race vehicle provides the player to purchase the vehicle for a defined purchase price, unless another player already owns the vehicle. If the vehicle is owned by another player, the player that lands on that position must pay a vehicle fee to the owner. Becoming race-qualified by purchasing a complete team of race vehicles is an overriding game play goal. Race qualified players are permitted to race for game points and game money, and may engage in a series of races reminiscent of real-world racing series, such as NASCAR, INDY RACING LEAGUE, or FORMULA 1.

29 Claims, 4 Drawing Sheets

RACING GAME

BACKGROUND OF THE INVENTION

The present invention generally relates to multiplayer games, and in particular relates to a multiplayer racing game.

Racing games enjoy enduring popularity. Some types of racing games, such as pure head-to-head competition games probably are best suited for implementation as computer games. Indeed, a plethora of such "pure" racing games exist for personal computers and the various gaming consoles. Gaming outcomes in these pure racing games largely depends on the relative game play skills of the players.

In other racing game variations, game rules mix head-to-head competition with at least elemental racing strategies to provide a richer game play experience. With this type of racing game, the game play outcome depends on both luck and strategy.

However, even with the existence of such games, there remains a need for a racing game that may be implemented as a computer game, or as a traditional board game, and that combines elements of luck and strategy in a manner that provides consistently captivating game play. Preferably, such a racing game would include elements that tie in with real-world racing events, such as with popular stock car racing series, to provide further elements of fan enjoyment.

SUMMARY OF THE INVENTION

The present invention comprises a racing game method and apparatus that permits players to engage in a racing game reminiscent of real-world racing, such as the type of team/series racing involved in NASCAR WINSTON CUP racing, or in FIA FORMULA 1 racing. In general, players take turns advancing their respective game play tokens around a race track, with the overriding goal of purchasing at least one complete team of vehicles. By owning at least one team, a player becomes eligible to chance race qualification and, in turn, becoming race-qualified permits a player to compete in game "races," which awards game money and game points. Thus, winning races enriches team owners and results in the accumulation of championship points, much like real-world racing series.

In an exemplary game play method, players move around a simulated race track that comprises a plurality of discrete track positions, wherein each track position corresponds to either a game command or to a race vehicle. Landing on a game command position requires the player to perform that command, which may have a penalty effect or a bonus effect, depending on the particular command landed on. Landing on a race vehicle allows that player to purchase the vehicle for a defined price, if another player does not already own that vehicle. If another player owns the vehicle, the player that lands on that vehicle must pay a vehicle fee to its owner. Since qualifying for races permits vehicle owners to increase the vehicle fees, a player gains significant advantage by quickly purchasing a complete team of vehicles, qualifying for one or more races and thus raising the vehicle fees for the cars owned by that player.

Complicating this task, the track positions representing the race vehicles are distributed around the track and interspersed with game command positions such that the vehicles corresponding to one particular team appear at different track positions. Thus, an element of luck comes into play because the opportunity to purchase the vehicles for a given team depends on that player individually landing on and purchasing all of the vehicles for that team before any other player. Indeed, one component of game strategy involves making so-called "blocking" purchases of one or more vehicles to prevent another player from collecting a complete vehicle team.

In addition to a game rules set, an exemplary embodiment of the present invention comprises a game board and a set of game tokens, or graphic representations thereof. That is, the game may be implemented as collections of physical pieces, or may be implemented through graphical representations on a computer screen for electronic game play versions. The exemplary game board, or board depiction, includes a representation of a simulated race track comprising a circuit of discrete track positions, preferably where each track position corresponds to a game command or a race vehicle as noted earlier.

One or more exemplary game embodiments further include a collection of game money in various denominations, one or more racing lists, sets of driver identification cards corresponding to the race vehicles and preferably styled according to the race team affiliation of each race vehicle, "finance cards" that correspond to finance-related game commands, fee increase cards and holders that denoted increased vehicle fees for given track positions, various game props, and miscellaneous scoring sheets to aid tracking the game progress. Exemplary game props include a tire change prop that determines tire change time penalties, and a race qualification spinner that introduces the element of chance into race qualification attempts by the players.

As noted above, the game may be defined with a racing theme that corresponds to a real-world racing series. As such, the present invention contemplates different embodiments of the game for different racing series, such as a NASCAR-themed game edition, possibly with particular editions for the WINSTON CUP series, the NASCAR LIGHTS series, the NASCAR TRUCK series, etc., and such as the FIA FORMULA 1 game edition or the IRL RACING LEAGUE game edition.

Such theme-based games are, in an exemplary embodiment implemented with fixed theme information, e.g., fixed race lists, driver identification cards, race team definitions, race vehicle graphics, etc., such that consumers must purchase new editions corresponding to real-world changes in teams and drivers, for example. In other exemplary embodiments, the game is themed using updateable themed elements. For example, the track positions corresponding to the various race vehicles may include an updateable label (e.g., through the use of replaceable labels or by allowing the installation of new label overlays). Thus, the present invention contemplates selling update sets such that a themed race game may be kept current with the real-world racing series on which that particular game edition is themed.

In any case, those skilled in the art will recognize the many opportunities for variation of game play, and the many possible game play strategies provided by the present invention upon reading the following detailed description, and upon viewing the associated drawings. However, those skilled in the art should understand that the present invention is not limited by the following exemplary details.

DETAILED DESCRIPTION OF THE INVENTION

Figure 1:
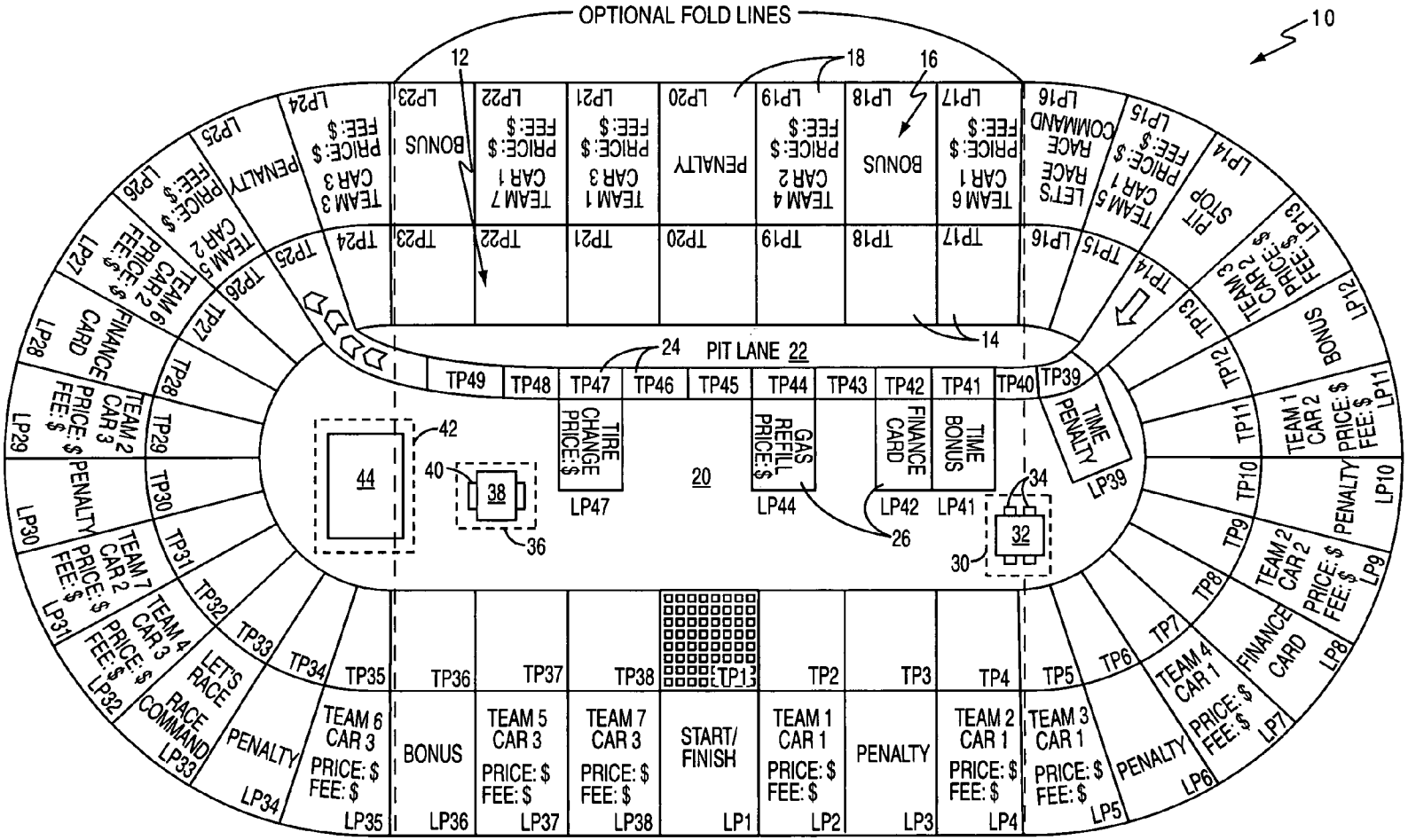
FIG. 1 is a diagram of a racing game according to an exemplary embodiment of the present invention.

Regardless of its implementation details, an exemplary racing game according to the present invention includes elements of luck, skill and player interaction to provide a captivating game play experience in which players first compete with each other to purchase one or more racing teams according to defined game play rules. With team ownership comes the opportunity to compete for additional game money and game points, which may be used to determine which player "wins" the game. By structuring the game play rules according to the details herein, players engage in a racing series competition that is reminiscent of real-world racing series, such as NASCAR or FORMULA 1. Indeed, some embodiments of the present invention include "themed" game editions patterned on such real-world racing series.

Regardless of whether the game is themed, generalized game play consists of players taking turns moving their game play tokens around a race track. Game play begins by allocating a certain amount of starting money to each player (game money). Players then take turns incrementally advancing their game play tokens around the track. At each turn, the player rolls dice, etc., to obtain a movement number that indicates the number of spaces that player should advance on the track for that turn.

Generally, each space or position on the track corresponds to a particular race vehicle, e.g., to a particular race car, or corresponds to a particular game command, e.g., a bonus command, or a penalty command. Thus, at each turn, the player's token movement generally results in that player either landing on a command position or on a car position. The car positions are distributed around the track so that different cars from different racing teams appear at various locations around the track, with the idea that the cars from a given team are not "clustered" but rather are spaced apart and interspersed with various game commands and with the cars from the other teams.

General game play roughly divides into three stages: a starting phase which focuses on team building, a race qualification phase, and a championship phase. Note that some players may advance to the next phase (or fall back to the prior phase) sooner or later than other players. Of course, exemplary variations of game play may eliminate or alter one or more of these game play phases.

At the start of the game, each player is allocated a certain amount of game money, which usually is allocated in equal shares. Players begin taking turns advancing their game tokens around the track. When a player lands on a track position corresponding to a car (more generally, a "race vehicle"), that player is allowed to purchase the car if it is not already owned by another player, and if that player has sufficient funds. If another player already owns the car, then a vehicle fee is due to that owner and must be paid by the player that landed on that space. Thus, landing on cars owned by other players' costs the player game money and can lead to bankruptcy, which is one mechanism for eliminating players.

As an overriding goal, players attempt to purchase all cars in one or more teams, because ownership of at least one complete team is required to chance race qualification. Qualifying for at least one race, i.e., becoming a race-qualified player makes that player eligible to participate in the championship racing aspects of game play, which yields bonus game points that may be used to determine an overall game winner. Further, each time a player qualifies for a race, that player increases the fee for at least one car owned by that player, according to a fee increase dictated by the particular race for which the player qualified.

FIG. 1 illustrates an exemplary game board 10 according to the racing game of the present invention. It should be noted that while the following descriptions generally correspond to physical game pieces, the present invention contemplates implementation in electronic game format and, thus, these descriptions should be understood as encompassing both physical and virtual game elements.

With the above in mind, the exemplary game board 10 generally comprises an inner racing track 12 of discrete track spaces or positions 14, a surrounding label set 16 comprising individual game board labels 18, and an infield area 20, which allows placement of one or more optional game play props on game board 10, and which includes a pit lane 22 that includes discrete pit positions 24 and additional command labels 26. An exemplary infield 20 includes an area 30 for placement of a qualification spinner 32, which may be held in place by retainers 34 (e.g., VELCRO strips), an area 36 for placement of a tire rack prop 38, which may have its own retainer 40, and an area 42 for placement of game play cards 44, the use of which is explained later herein.

Further, it should be noted that the track position numbers (TP1–TP38 for the main track 12, and TP39–TP49 for the pit lane 22) and the label position numbers (LP1–LP38 for label positions corresponding to the main track 12, and selected ones of LP39–LP49 corresponding to pit lane 22) generally are not printed on the game board 10. Instead, these track and label positions are illustrated to emphasize the correspondence between particular track/pit lane positions and particular label positions to emphasize that, for example, "landing" on the track position identified as TP3 has the effect of landing on penalty label LP3. Also, note that in one or more game variations, players move around label area 16 rather than around track 12, unless a "race" is underway.

According to the general game play described above, each player takes a turn, at which the player rolls dice, etc., to obtain a movement number, which dictates the number of track positions 14 to advance for that turn. Since each track position 14 corresponds to a particular label 18, one may think of a track position 14 as being either a car position or a command position. Landing on a car position requires payment of the vehicle fee if the car is owned by another player, or allows the player to purchase the car if another player does not own the car. Landing on a command position requires the player to perform that command, which may be a penalty effect command (skip a turn, pay money, etc.) or may be a bonus effect command (take an extra turn, receive extra money, etc.).

In an exemplary embodiment, the rule set defines a plurality of race teams, with one or more cars in each team.

Thus, the game may define Teams 1 . . . 6, each comprising Cars 1 . . . 3. The label set 16 would thus include individual labels 18 carrying depictions of particular cars in the defined teams. In general, no two labels 18 depict the same team car, such that no two track positions 14 correspond to the same car for the same team. However, the same game command may appear at various track positions 14.

In any case, as game play progresses, the individual players attempt to purchase as least one complete team of cars, which requires luck to the extent that one must by chance land on each car within a given team to have the opportunity to make such purchases. Thus, an unlucky player might run several laps around track 12 as the game progresses before successfully completing his or her first team purchase. On this point, an exciting element of inter-player competition comes into play, inasmuch as players may make strategic "blocking" purchases.

With blocking, a player lands on and buys a particular car not because that player needs to complete one of his or her own teams, but because another player needs it to complete that other player's team. The purchase thus denies that other player the opportunity to complete the intended team purchase. In some variations of game play, players can barter or bargain with each other for needed cars. Thus, a car bought by a player as a blocking purchase against another player may be traded for a blocking purchase made against him or her. In an exemplary car trading scheme, players may trade cars among themselves as needed, and may sell cars back to the game "bank" but such sales are at a 50% reduction in the car's value.

Figure 2:
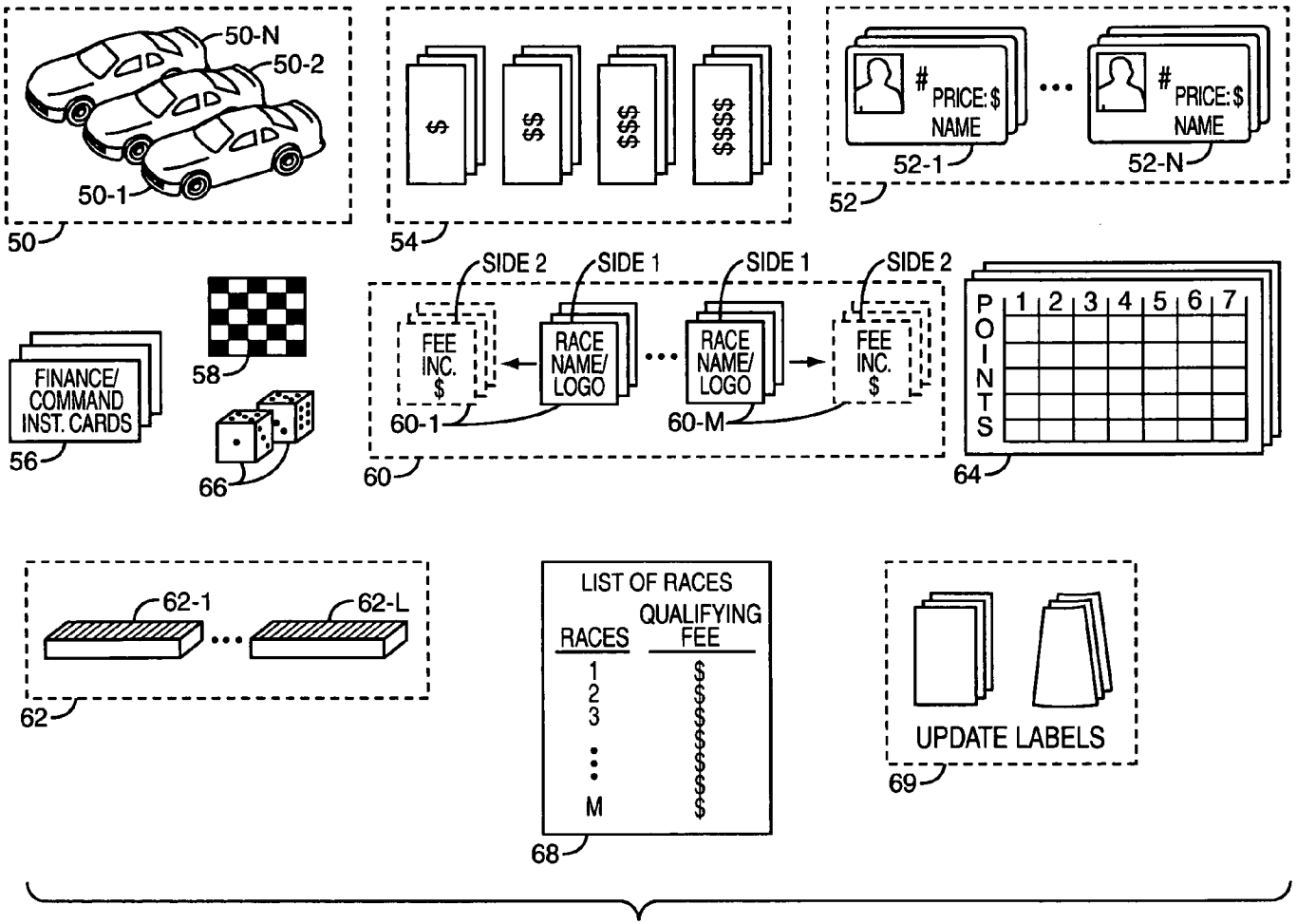
FIG. 2 is a diagram of various game play devices, some or all of which may be included in an exemplary game set.

FIG. 2 illustrates an exemplary set of supporting game play items, some or all of which may be used in various versions of game play. As shown, the exemplary game set includes game play tokens 50, preferably styled as miniature race vehicles (shown here as race cars), "driver" identification cards 52, game money 54 in varying denominations, "finance" command cards 56, a checkered flag token 58, vehicle fee enhancement cards 60 and corresponding slotted holders 62, game play scoring sheets 64, game die 66, a racing list placard or sheet 68, and, optionally, replacement labels 69.

As was described above, advancing in the game and gaining advantage over the other players depends on qualifying for races, which requires team ownership. Once a player buys all vehicles in a given team, that player is eligible to chance race qualification. Chancing qualification for a race brings another game prop into play.

Figure 3:
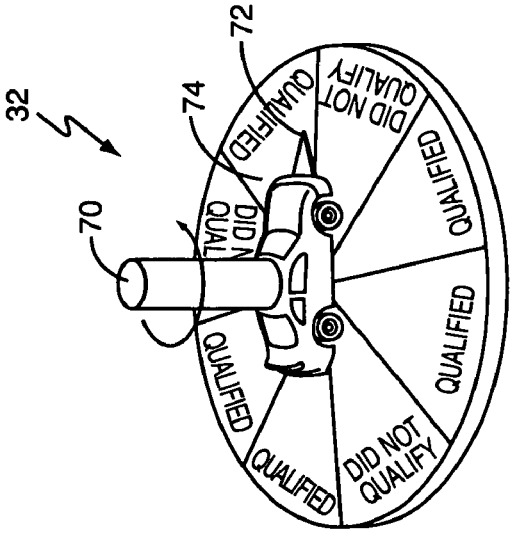
FIG. 3 is a diagram of an exemplary "race qualifying spinner" game prop, which may be used in one or more game embodiments.

FIG. 3 illustrates a race qualification spinner 32 that introduces an element of chance into the player's attempt at race qualification. In practice, once a player purchases a complete team of race vehicles, that player is allowed to pay a qualification fee for a race listed on race list 68, and then use the spinner 32 to attempt to "qualify" for that race. More particularly, an exemplary game rule requires that a player first buy all vehicles in at least one team, and then subsequently land on a vehicle within one of those owned teams before the player is permitted to chance race qualification.

Race list 68 preferably includes a defined list of races, with each race having its own qualification fee. In exemplary game play, the player attempting to qualify would pay the required fee for a particular one of the races appearing on racing list 68, and would then actuate spinner 32. Spinner 32 comprises a central post 70 having a spinner pointer 72, which may be a race vehicle-based pointer, that is centrally positioned within a surrounding area 74 that is segmented into "Qualified" (Q) and "Did Not Qualify" (DNQ) sections. Thus, the player spins post 70, which causes it to rotate. If the pointer 72 comes to rest pointing to a Qualified segment, the player is deemed to have qualified for that race. If the spinner 72 comes to rest pointing at a DNQ section, the player is deemed to have failed qualification and the qualification fee is forfeited. Note that spinner 32 could use ball bearing or "flywheel" mechanisms to increase its spin time for a greater element of suspense.

Racing list 68 may include a number of races (e.g., races 1 . . . M) from which players can select a race for which qualification is to be attempted. In exemplary game embodiments, racing list 68 is patterned after a real-world racing series. Thus, racing list 68 may list all of the races comprising the WINSTON CUP series, or all of the races on the FORMULA 1 circuit. In any case, one benefit of qualifying for a race is that the player is eligible to increase the vehicle fees for one or more race vehicles owned by that player. In an exemplary embodiment, each time a player qualifies for a race, the player chooses one vehicle owned by that player to receive the fee increase. Generally, the player must identify which of his or her "owned" teams will attempt to qualify for the race prior to chancing qualification, and the fee increase must be applied to a vehicle in that designated team.

Races listed on race list 68 may have varying qualification fees and varying vehicle fee increases. Thus, while one race may cost more than another race, its vehicle fee increase also may be greater. Thus, there is an incentive to put more game money at risk to gain greater vehicle fees. Indeed, the track positions 14 corresponding to vehicles whose owners have qualified for many races become quite costly to land on, and may result in "bankrupting" one or more other players unlucky enough to land on those positions.

In an interesting variation on game play, an "investing" option is allowed, wherein a player whose token 50 is at risk for landing on a track position 14 that corresponds to a vehicle owned by another player may "invest" in that vehicle. For example, the player may, in advance of moving his or her token 50, pay half the total vehicle fee to the vehicle's owner (i.e., half of the combined value of the base fee plus any fee enhancements gained by race qualification). The player then rolls die 66, or otherwise generates a movement number, and moves his or her token 50 the required number of spaces. If he or she lands on the vehicle invested in, the player gains back some or all of the investment, but if the token 50 does not land on the vehicle invested in, the investment payment is forfeited to the car owner. The game rules may be structured to limit investment opportunities to no more than two vehicles at a time, and may limit the number of track positions in advance of a given vehicle in which an approaching player is permitted to elect such investments.

To indicate the increased vehicle fees gained through race qualification, a player is given a block 62, which is slotted to hold a number of qualification cards 60 that are used to show which races a particular vehicle has qualified for, and to show the corresponding fee increases. Thus, a player may place a block 62 beside or on a vehicle label 18 and then add qualification cards as needed.

Preferably, there is a set of qualification cards 60 for each race listed on race list 68. For example, if there are sixteen races and the game is meant to accommodate six players, preferably there are at least six qualification cards 60 for each of the sixteen races, i.e., set 60-1 for race 1, set 60-2 for race 2, and so on. In an exemplary embodiment, the front of each qualification card includes a race logo or other identifier, and the reverse of each qualification card lists the vehicle fee increase gained by qualifying for that race.

A more important benefit of becoming race qualified is that only race-qualified players are eligible to participate in special race events, which are triggered when a race-qualified player lands on a track position 14 that corresponds to a special "Let's Race" game command. The exemplary track 12 has two or more track positions that correspond to the "Let's Race" command.

When the "Let's Race" command is triggered, the game play of non race-qualified players is suspended, and the tokens 50 of all race-qualified players are moved to the track position 14 labeled "Start/Finish." All such race-qualified players then take turns incrementally advancing their game tokens around track 12, with the first player to lap track 12 being designated the race winner. Of course, game play rules permit race-qualified players may elect to race for more than one lap. In any case, the winner collects game money and game points, which points may be used like driver championship points in real-world racing series. That is, the first player to amass a defined number of game points may be considered the game winner, or the player with the most point and/or money at the end of a defined game play time may be declared the winner. Descending point and money awards may be given to second, or second, third, and fourth finishes, and so on.

In an exemplary game play variation, the first player to amass a given number of points, say, for example, ten points, is awarded a special game token 50, a "golden car" token. The golden car may be used for one lap of game play and, during its use, that player is exempted from all game penalties (and, optionally, exempted from all bonuses) and is not required to pay vehicle fees to any other players. Essentially, lapping track 12 with the golden car gives the player an opportunity to take acquired cars from other players.

In another exemplary game play variation, the "team creation" phase of the game is accelerated by giving a "checkered flag" 58 to the player with the most cars. The flag 58 eliminates all penalty commands and doubles all bonus commands. Preferably, the flag 58 does not affect the vehicle fees paid to other players. In awarding the flag, if two players have the same number of cars, the player owning the car or cars with the greater cumulative value is awarded the flag. Once any player purchases a complete team, the checkered flag 58 is retired.

With regard to game commands, it was noted that exemplary game commands generally were either penalty commands or bonus commands. An exemplary command set includes:

(Penalties)
CHIROPRACTIC VISIT—pay fee
TIME PENALTY—wait one turn
RACE INJURY—wait one turn plus pay a fee
PULL FINANCE CARD—pull one of cards 56 and follow finance instructions
PIT STOP—enter pit lane
GAS REFILL—roll a number and pay a fee ($×number)
TIRE CHANGE—roll tires and pay a fee ($×# of penalty sides), wait two turns
TRACK COLLISION—wait one turn and pay a fee
(Bonuses)
BEST LAP TIME—move again, receive bonus money
RACE VICTORY—receive bonus money
FASTEST PIT TIME—advance to end of pit lane
(Special Bonuses)
START/FINISH LAP COMPLETION—receive lap completion bonus ($ or $$)
LET'S RACE—trigger special game race event for race-qualified players Note that an exemplary variation on the time penalty command (several labels 18 may carry time penalty commands) is based on the following logic: when a player lands on a time penalty track position 14, that player is required to wait a calculated penalty time, and, if another player is still waiting under a previous time penalty, that other player is relieved by the newly penalized player. A suggested penalty time calculation is to enforce a game-play time suspension penalty equal to the number of players participating in the game, i.e., two players—two minutes, three players—three minutes, and so on.

With the above exemplary game commands distributed at different label positions around the board, players incrementally advancing their tokens around the track 12 encounter a mix of vehicle positions, bonus positions, and penalty positions. Also, note that the completion of each lap around track 12 by a player, which is designated as that player's token moving through the START/FINISH track position, may be rewarded by the payment of game money, $20 for example. As an extra bonus, actually landing the START/FINISH position may confer an enhanced award, $40 for example. In this manner, even players having difficulty amassing teams and qualifying for races receive at least a minimal infusion of game money each lap, which helps keep such players "in the game," and provides opportunities to rebuild money reserves.

Figure 4B:
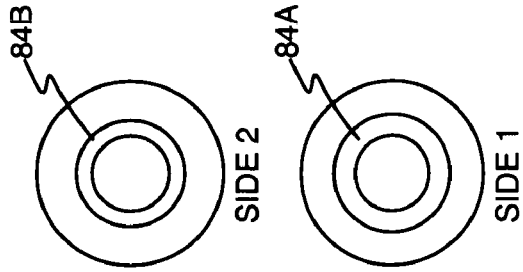
FIGS. 4A and 4B are diagrams of an exemplary "tire change penalty" game prop, which may be used in one or more game embodiments.
Figure 4A:
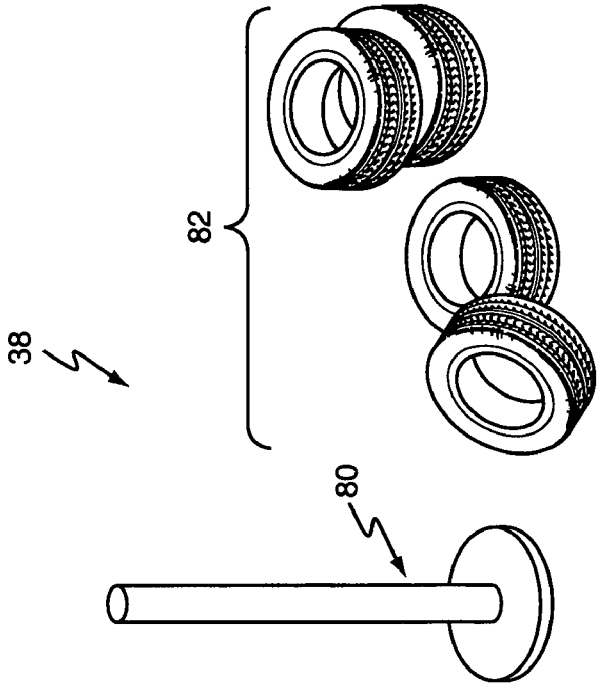

Further, one or more additional game props may be used in combination with certain ones of the game penalties. For example, players that land on a track position 14 corresponding to the pit lane entrance must detour through pit lane 22, which puts those players at risk for certain pit lane penalties, such as gas refill and tire changes. To make game play more captivating, FIGS. 4A and 4B illustrate a tire rack 80 (with removable tires 82) that may be used to determine the severity of a tire change penalty.

With this approach, the player landing on the tire change penalty position removes the stacked tires 82 from rack 80 and drops them. Each tire has a first side 84A and a second side 84B, which may be differentiated by color or other markings. Designating side 84A as the penalty side, the number (#) of tires the player must "change" is thus determined by counting how many of the tires 82 landed penalty-side up. The player may be required to "shake up" the tires 82 in his or her hand before dropping them to ensure a more random outcome. Then penalty calculation may include multiplying a base tire change fee by the number of tires that land penalty-side up, and by multiplying a base turn wait time by the same number of penalty-side up tires 82.

Figure 6B:
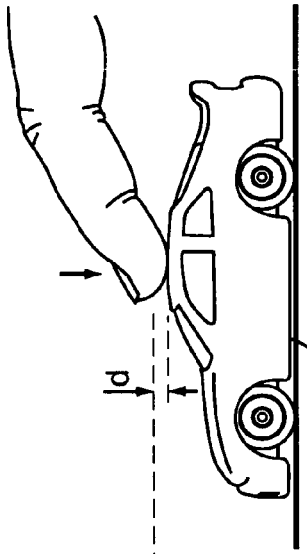
FIGS. 6A, 6B and 7 illustrate exemplary methods of sensing player actuation of a number generating game token.
Figure 6A:
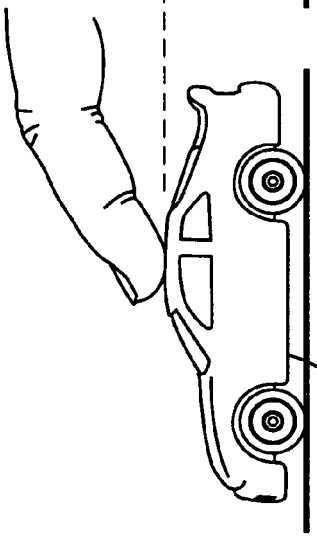
Figure 5:
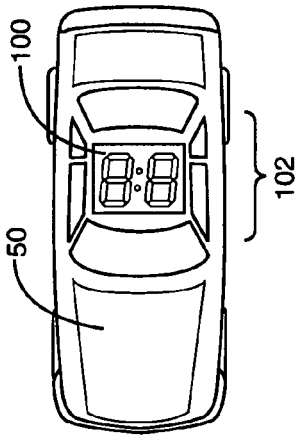
FIG. 5 is a diagram of an exemplary number generating game token prop, which may be used in one or more game embodiments.

FIG. 5 illustrates another game enhancement in which each game token 50 includes a visible display 100 to display movement numbers 102. With this approach, the movement number generated at each player's turn would be obtained from that player's game token 50 rather than by rolling the dice 66. In an exemplary embodiment, each game token 50 is styled like a race car and may have a mock "suspension" that permits the player to actuate movement number generation by pushing down on the token 50. This scenario is illustrated in FIGS. 6A and 6B, which illustrate the token 50 being actuated by a player's finger press. It should be noted that a simple spring or biasing member in token 50 could be used simply to give the impression of a working automobile suspension; nothing elaborate is required.

Figure 8:
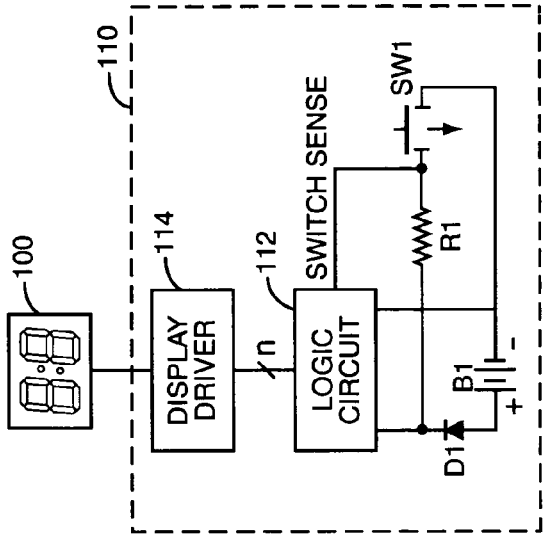
FIG. 8 is a diagram of an exemplary number generator to be used in an exemplary game token.
Figure 7:
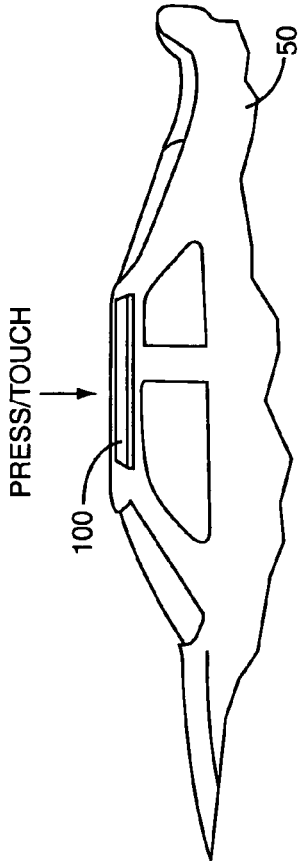

Indeed, FIG. 7 illustrates another exemplary embodiment where the display 100 serves as the "actuating button" for movement number generation, such that pressing on display 100 initiates generation of the movement number. In any case, FIG. 8 illustrates an exemplary movement number generator to drive display 100. Movement number generator 110 may be included in token 50 and, in an exemplary embodiment, it comprises a logic circuit 112, a display driver 114, a resistor R1, a contact or other type of sensing switch SW1, and a battery B1, with or without a series diode Dl for reverse polarity protection. Note the battery may or may not be replaceable.

SW1 may be an actual momentary contact switch, it may be a reed switch (magnetic), or may be a Hall effect or some other type of sensing switch that is activated responsive to the player pressing on token 50. Regardless, movement number generator 110 generates a preferably random or pseudo random number responsive to such player actuation. The value of the generated number may be constrained to those discrete values obtainable from the die 66, or different numbers may be allowed.

Further, it may be noted that the game play experience can be enhanced by patterning the display numbers 102 after an elapsed time counter or lap timer used in real-world racing. Thus, actuation of the movement number generator 110 might result in a count-down or count-up sequence appearing on display 100, such that it appears a lap timing function is running, the ending of which results in display 100 displaying the number of spaces to be moved by the player for that turn.

It should be understood that movement number generator 110 may be implemented in a variety of ways, and that those skilled in the art will appreciate the various low-power and low-cost logic and display circuits developed for watches and inexpensive toys illustrate how compactly and economically such circuits can be implemented. In general, the present invention contemplates including movement number generation capability into the game play tokens 50 for an enhanced game play experience.

The present invention thus comprises a game board, a corresponding set of game rules having several exemplary variations of game play, and one or more supporting game play devices, including novel game play props that enhance the racing "feel" of the game. In accordance with the above details, a summary of exemplary game rules comprises the following items:

Team definitions—the rules define multiple race teams, such as seven teams of three cars each, with the cars from all of the teams graphically depicted at various labels 18 around track 12; the purchase price and vehicle fee for each car in each team may be varied such that some teams are more expensive to collect but yield greater vehicle fees for their owners during game play;

Game start—each player is allocated $500; the exemplary game set has tokens 50-1 . . . 50-7 to support up to seven players;

Stage 1—players attempt to buy at least one complete team of cars to become race qualified players; player with most cars is awarded "checkered flag" 58, which doubles all bonuses and eliminates all penalties (flag is retired from game play after the first team is collected; players are awarded $20 for each lap of track 12 completed ($40 if the player lands on the Start/Finish position);

Stage 2—players collect at least one complete team and chance at race qualification; preferably, there are a plurality of races define, e.g., sixteen races, and a player can only attempt to qualify one team per race; ideally, the races have different qualification fees, but the more expensive races would have the benefit of higher increases in the vehicle fees;

Stage 3—racing in this stage is triggered by any race-qualified player landing on the "Let's Race" game command (several labels 18 may be so designated); when a race is triggered, all race-qualified players move their tokens 50 to the Start/Finish position and take turns advancing around the track; points and money may be awarded to the first and second place positions (i.e., the first and second race-qualified players to complete a lap of track 12 during the "Let's Race" lap);

Golden car—the first player to reach, say, 10 game points, is awarded a "Golden car" token 50, which the player uses until the next player reaches the points threshold; when the player is awarded the golden car, that player is allowed to complete one "winner's lap" of track 12 during which the game play of the other players is suspended, and during which the player is permitted to take possession of any car landed on; the score sheets 64 may be used to track and tally players' point standings;

Game finish—the game may be ended based on "Last Player Standing" rules where game play is based on eliminating (i.e., bankrupting) other players, may be based on "Points Champion" rules, which designates the first player to achieve a defined number of game points as the game winner, or may be based on "Timed Play" rules, which limits game play time to a fixed period, and in which the player with the most money or points at the end of that time is declared the winner.

Of course, many other variations on exemplary game play exist. For example, a "speed version" of the game omits the Stage 1 (team building) part of game play by allowing players to draw for teams at the outset of the game. Players may roll dice 66 (or use the movement number generators 110 in tokens 50), to obtain random numbers. As such, a player would roll a number and then would be awarded the team corresponding to that number. The team number for each team may be printed on, for example, the driver IDs 52 corresponding to that team.

Suggested team divisions in the speed version include these allocations:

2 players—each player draws three teams, the last team is up for sale (assuming the game is defined to have seven teams available for purchase);

3 players—each player draws two teams, the last team is up for sale;

4 players—each player draws 1 team, the last three teams are up for sale;

5 players—each player draws 1 team, the last two teams are up for sale;

6 players—each player draws 1 team, the last one team is up for sale;

7 players—each player draws 1 team.

Of course, other allocations are possible.

While the above rules contribute to the real-world racing aspects of the game, part of the racing feel may derive from the themed aspects of the game, which may be varied for different game "editions," i.e., a NASCAR edition, a FORMULA 1 edition, etc. As such, the graphics used on the labels 18 may be tailored to the particular racing theme desired.

In particular, the game rules define racing teams comprising individual racing vehicles, the depictions of which are distributed around the track 12. These teams may be actual real-world racing teams, and the labels 18 used to depict the cars from such teams may include real-world graphic depictions of cars from such teams (color schemes, numbers, decals, sponsor information, etc.). Further, as players buy teams and qualify for races, they may be awarded driver identification cards 52, which may carry generic or make-believe driver pictures and names, but may carry real-world driver identifications corresponding to actual persons.

Of course, because the teams, drivers, and sponsors that participate in actual racing series changes from season to season, a themed edition of the inventive game may become outdated and, to some extent, might begin to lose its appeal as its fixed team/driver thematic elements became increasingly at odds with the real-world racing series it was patterned after. Thus, the present invention further contemplates that the labels 18 may be replaceable (e.g., slide in/slide out) or may simply be overlaid with new labels 18. Thus, FIG. 2 illustrates that update packs may be provided separately from the primary game set wherein such update packs at least include update labels 69 (replacements labels, i.e., slide-in/slide-out, or new label overlays for game board 10). Other game devices, such as the race list 68, driver IDs 52, game tokens 50, and race qualification cards 60, also might be included in an exemplary update pack.

As an alternative to update packs, the game provider may simply choose to issue new themed editions with updated information on a seasonal or other periodic basis. Those skilled in the art will recognize these and other opportunities the present invention provides for effectively integrating details of real-world racing into the game play experience. Indeed, those skilled in the art should appreciate that, in general, the present invention is not limited by the foregoing exemplary details but rather is limited only by the following claims and the reasonable equivalents thereof.

What is claimed is:

1. A racing game comprising:

a race track comprising a circuit of discrete track positions, wherein each track position corresponds to a particular race vehicle associated with a particular race team or to a particular game command, and wherein there are race vehicles for at least two race teams distributed around the race track;

a set of game tokens, each token used to represent the movement of an individual player around the race track;

game money to be used by the players in support of game play;

a race list that identifies one or more races for which players may chance at qualification; and a qualification spinner used to chance race qualification;

wherein an object of the game is for individual players to land on and buy the race vehicles for at least one race team and thereby become eligible to chance at qualifying for a selected race appearing on the race list, and wherein chancing qualification comprises spinning the qualification spinner; and wherein one of the particular game commands is a tire change penalty command, and the racing game further comprises a tire change penalty prop that is used to determine a severity of the tire change penalty, said tire change penalty prop comprising a set of model tires, each having a color-coded side, such that a player may toss the set of tires and determine the severity of the penalty based on the number of tires that land color-coded side up or side down.

2. The game of claim 1, wherein each game token comprises a model race vehicle that includes a movement number generator that generates and displays a number of track positions to be moved at each turn.

3. A racing game play method comprising:

providing a race track that comprises a circuit of discrete track positions, wherein each track position corresponds to a particular race vehicle associated with one of two or more race teams, or corresponding to a particular game command, and further providing two or more game tokens, each token used to represent the movement of an individual player around the race track;

allowing players to take turns incrementally advancing their game tokens around the race track, wherein any player landing on a game command is required to perform that game command, any player landing on a race vehicle is allowed to purchase that vehicle if that race vehicle is not already owned by another player, and any player landing on a race vehicle already owned by another player is required to pay a vehicle fee to that other player; and allowing any player that purchases a complete team of vehicles and subsequently lands on one of the race vehicles in that team to chance at race qualification by paying a qualification fee, wherein successful race qualification increases the vehicle fee for one or more of the race vehicles in that race team and marks that player as a race-qualified player.

4. The method of claim 3, further comprising initiating a race between race-qualified players if a race-qualified player lands on a track position corresponding to a race command, and wherein racing comprises moving game tokens for all racers to a starting track position, allowing the racers to take turns incrementally advancing their game tokens around the race track, and awarding game points to at least the first place winners as determined by the order in which the racers complete one lap of the race track.

5. The method of claim 4, further comprising declaring a game winner based on the first player to accumulate a defined number of game points.

6. The method of claim 4, further comprising awarding a special game token to the first player to accumulate a defined number of game points for use in at least one lap of game play, and wherein that player is allowed to claim ownership of any vehicle landed by the special token, and is permitted to ignore any game command landed on by the special token.

7. The method of claim 4, further comprising determining a winner of the game by one of a last-player-standing rule determined as a function of players running out of game money, a points-champion rule determined as a function of which player accumulates a greatest number of game points, or a time-limit rule determined as a function of which player has a greatest number of game points or amount of game money upon reaching a defined game play time limit.

8. The method of claim 3, further comprising, for a period of game play before there are any race-qualified players, designating the player who owns a greatest number of cars as a checkered flag holder, and eliminating all penalty game commands for the checkered flag holder and doubling all vehicle fees due the checkered flag holder.

9. The method of claim 3, further comprising, during game play as players advance their game tokens around the race track, permitting a player at risk of landing on a particular race vehicle owned by another player to pay a reduced fee in advance of moving his or her game token, wherein the reduced fee is forfeited if the player does not land on the particular vehicle, and wherein the reduced fee is returned if the player does land on the particular vehicle.

10. The method of claim 3, wherein one game command is a pit command, and further comprising requiring players landing on the pit command to advance their game tokens through a pit lane comprising a series of discrete pit lane positions that run adjacent a portion of the race track, and further comprising defining one or more penalty commands to correspond to particular pit lane positions, such that a player landing on one of those particular pit lane positions incurs a game penalty.

11. The method of claim 10, wherein one penalty command in the pit lane is a tire-change command, and further comprising requiring a player landing on the tire-change command to drop a set of simulated race tires, each having first and second sides, and further determining a severity of the tire-change penalty based on the number of dropped race tires that land first side up.

12. The method of claim 3, allowing players to take turns incrementally advancing their game tokens around the race track according to game play rules is a function of a variable token movement number generated at each player's turn, wherein the token movement number represents the number of track positions the game token for the player is to be advanced at each turn.

13. The method of claim 12, further comprising incorporating a movement number generator and display into each game token, such that each player uses his or her own game token to obtain the movement number for each turn by that player.

14. The method of claim 13, further comprising styling each game token as a race car and incorporating the display for the movement number into a top surface of the race car.

15. The method of claim 3, further comprising defining a game theme to correspond to a real-world racing series, and wherein defining a game theme at least comprises styling depictions of the race vehicles based on real-world racing vehicles and real-world racing team affiliations from a particular real-world racing series.

16. The method of claim 15, further comprising releasing game updates based on updating the styling depictions of the race vehicles based on vehicle, driver, and team changes in the corresponding real-world racing series.

17. The method of claim 15, further comprising issuing a driver identification card for each race vehicle purchased by a player that corresponds to an actual driver of the real-world racing vehicle represented by the purchased race vehicle.

18. A racing game comprising:

a simulated race track comprising a circuit of discrete track positions, wherein each track position corresponds to a particular race vehicle from one of two or more race teams, or corresponds to a particular game command;

game tokens to allow players to take turns incrementally moving around the race track;

a qualification spinner that comprises a spinner positioned within a label area, the label area being divided into a plurality of interspersed qualified and did-not-qualify segments, such that a player chances a race qualification by spinning the spinner; and game rules to control movement of the players' game tokens around the race track, wherein any player landing on a game command is required to perform that game command, any player landing on a race vehicle is allowed to purchase that vehicle if the vehicle is not already owned by another player, and any player landing on a race vehicle already owned by another player is required to pay a vehicle fee to that other player; and wherein any player that purchases a complete race team of race vehicles and subsequently lands on one of the race vehicles in that race team to chance at race qualification by paying a qualification fee, wherein successful race qualification increases the vehicle fee for a vehicle in that team and marks that player as a race-qualified player.

19. The game of claim 18, wherein the simulated race track comprises a defined area of a game board, and wherein the game board comprises:

a track area to depict the simulated race track; and an outer label area surrounding the track area and including discrete label positions in correspondence to the discrete track positions, such that label information in each label position denotes the corresponding track position as a race vehicle position or as a game command position.

20. The game of claim 19, wherein each label position includes a label, and wherein each race vehicle label includes a depiction of a particular race vehicle and each game command label denotes a particular game command.

21. The game of claim 20, wherein the race vehicle labels are styled according to a real-world racing series.

22. The game of claim 20, wherein at least the race vehicle labels comprise replaceable labels or labels that can be overlaid to permit updating the depictions of the race vehicles.

23. The game of claim 22, wherein the race vehicle labels depict race vehicles from a real-world racing series, and wherein the game is updated by changing or overlaying existing race vehicle labels with updated race vehicle labels.

24. The game of claim 23, further comprising updated label sets that permit the game to be updated with new race vehicle labels.

25. The game of claim 18, further comprising a race list that defines a plurality of races and corresponding qualification fees for which players can chance race qualification, such that a player chancing race qualification is permitted to select a race from the race list.

26. The game of claim 25, wherein the race list corresponds to a list of real-world races from a particular real-world racing series.

27. The game of claim 18, further comprising a set of driver identification cards, each driver identification card corresponding to a particular race vehicle, such that a player that purchases a particular race vehicle is awarded the corresponding driver identification card.

28. The game of claim 27, wherein the set of driver identification cards corresponds to a group of real-world racing drivers associated with a particular real-world racing series.

29. The game of claim 18, wherein each game token comprises a model race vehicle that includes a movement number generator and display to generate and display a movement number that determines a number of track positions the game token is to be advanced at each turn.

* * * * *